US007518075B2

(12) United States Patent
Wrede et al.

(10) Patent No.: US 7,518,075 B2
(45) Date of Patent: Apr. 14, 2009

(54) ENERGY ACCUMULATOR

(75) Inventors: Silke Wrede, Zeitlarn (DE); Klaus Hoepfl, Maxhütte-Haidhof (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 224 days.

(21) Appl. No.: 11/661,893

(22) PCT Filed: Apr. 29, 2006

(86) PCT No.: PCT/EP2006/004042

§ 371 (c)(1),
(2), (4) Date: Mar. 1, 2007

(87) PCT Pub. No.: WO2006/133766

PCT Pub. Date: Dec. 21, 2006

(65) Prior Publication Data

US 2008/0093207 A1 Apr. 24, 2008

(30) Foreign Application Priority Data

Jun. 15, 2005 (DE) ..... 10 2005 027 524

(51) Int. Cl.
*H01H 5/00* (2006.01)

(52) U.S. Cl. ..... 200/400; 200/11 TC; 123/447; 137/447

(58) Field of Classification Search ..... 200/400–402, 200/6 R, 11 TC, 11 A, 11 B, 11 K, 501–502; 137/540; 123/447
See application file for complete search history.

(56) References Cited

U.S. PATENT DOCUMENTS

| | | | | |
|---|---|---|---|---|
| 5,034,578 | A * | 7/1991 | Lauterwald | 200/11 B |
| 5,315,078 | A * | 5/1994 | Freymuller | 200/11 TC |
| 6,347,615 | B1 * | 2/2002 | Hopfl et al. | 123/447 |
| 6,693,248 | B1 * | 2/2004 | Schultz | 200/11 TC |
| 6,838,629 | B2 * | 1/2005 | Baertl | 200/501 |
| 6,998,547 | B2 * | 2/2006 | Kloth et al. | 200/6 R |

FOREIGN PATENT DOCUMENTS

GB 2014794 A 8/1979

* cited by examiner

*Primary Examiner*—Kyung Lee
(74) *Attorney, Agent, or Firm*—Andrew Wilford

(57) ABSTRACT

The invention relates to a novel energy accumulator for a load step switch for rapid, continuous switching between various winding tappings. Said energy accumulator comprises a lifting carriage and a jumping carriage, which follow the movement of the jumping carriage in a jumping manner. Both of the carriages are guided along three parallel guiding rods. The lifting carriage and the jumping carriage comprise, respectively, three linear roller bearings which respectively surround one of the three guiding rods.

4 Claims, 4 Drawing Sheets

ENERGY ACCUMULATOR

CROSS REFERENCE TO RELATED APPLICATIONS

This application is the U.S. national phase of PCT application PCT/EP2006/004042, filed 29 Apr. 2006, published 21 Dec. 2006 as WO 2006/133766, and claiming the priority of German patent application 10/2005027524.9 itself filed 15 Jun. 2005.

The invention relates to a force accumulator for a load tap changer.

Load tap changers serve for the interruption-free change-over between different taps a step transformer under load. Since this change-over takes place usually suddenly, load-tap changers usually have a force accumulator.

Such a force accumulator is already well-known from DE-PS 19 56 369 as well as from DE-PS 28 06 282. It is wound up at the beginning of each cycle of the load tap changer by its input shaft, i.e. loaded. The well-known force accumulator essentially consists of an wind-up slide and a jump slide, between which force-storing springs are arranged.

With the well-known force accumulator two guide rods are provided on which the wind-up and jump slide are independently longitudinally shiftable. At the same time the guide rods support and guide for the force-storing springs, with each spring surround a respective rod.

The wind-up slide is longitudinally displaced by an eccentric disk connected with the input shaft relative to the jump slide, so that the force-storing springs between them are loaded. If the wind-up slide reaches its new end position, the jump slide is unblocked. It follows now suddenly, launched by the loaded force-storing springs, to follow the earlier longitudinal and linear movement of the wind-up slide. This sudden movement of the jump slide is converted into a rotation of an output shaft. This serves again to actuate the load tap changer, that is to change between the previous and the next winding tap under load.

In the known force accumulator the wind-up slide and the jump slide have an open four-point mount: they are support at each of their upper and lower ends on two parallel guide rods and are guided by them.

The known force accumulator requires that the guide rods be perfectly parallel for proper guiding of the moveable parts, as otherwise a wedging or stiffness would be encountered by the wind-up or jump slide. Stiff action of the jump slide can cause it to not reach its end position and thus not properly effect the changeover of the tap changer since the force accumulator does not lock into its new end position.

It is an object of the invention to provide a force accumulator of the above-described type that is of simple construction and that is also particularly reliable in service.

This object is attained by a force accumulator with the features of the first patent claim. The dependent claims relate to particularly advantageous embodiments of the invention.

With the arrangement according to the invention of three parallel guide rods and the overlapping 3-point mounts of both wind-up and jump slide an optimal guidance of these parts needing enormous mechanical precision. It is particularly reliable in service and easily resists substantial transverse forces, for example with an assist device, relative to the prior art.

The invention is more closely described in the following with reference to drawings and by way of example. Therein:

FIGS. 1 to 3 show a force accumulator according to the invention in different views, all views not showing the hereinafter described parts so that not every reference numeral is in each view. In addition in FIG. 2 for clarity of view the force-storing springs and the force-accumulator support are not shown.

Figure 1:
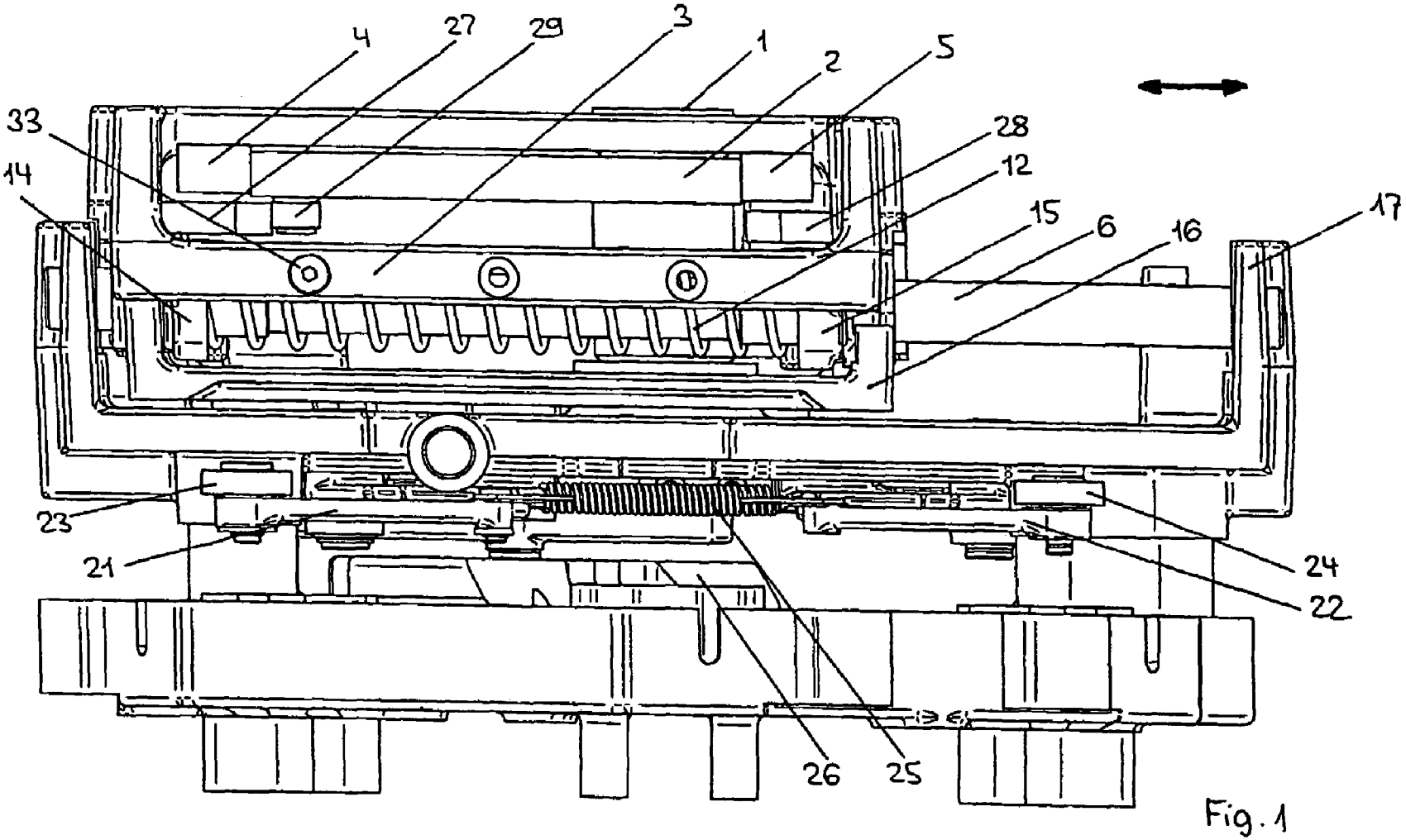
FIG. 1 is a side view of a force accumulator according to the invention.
Figure 2:
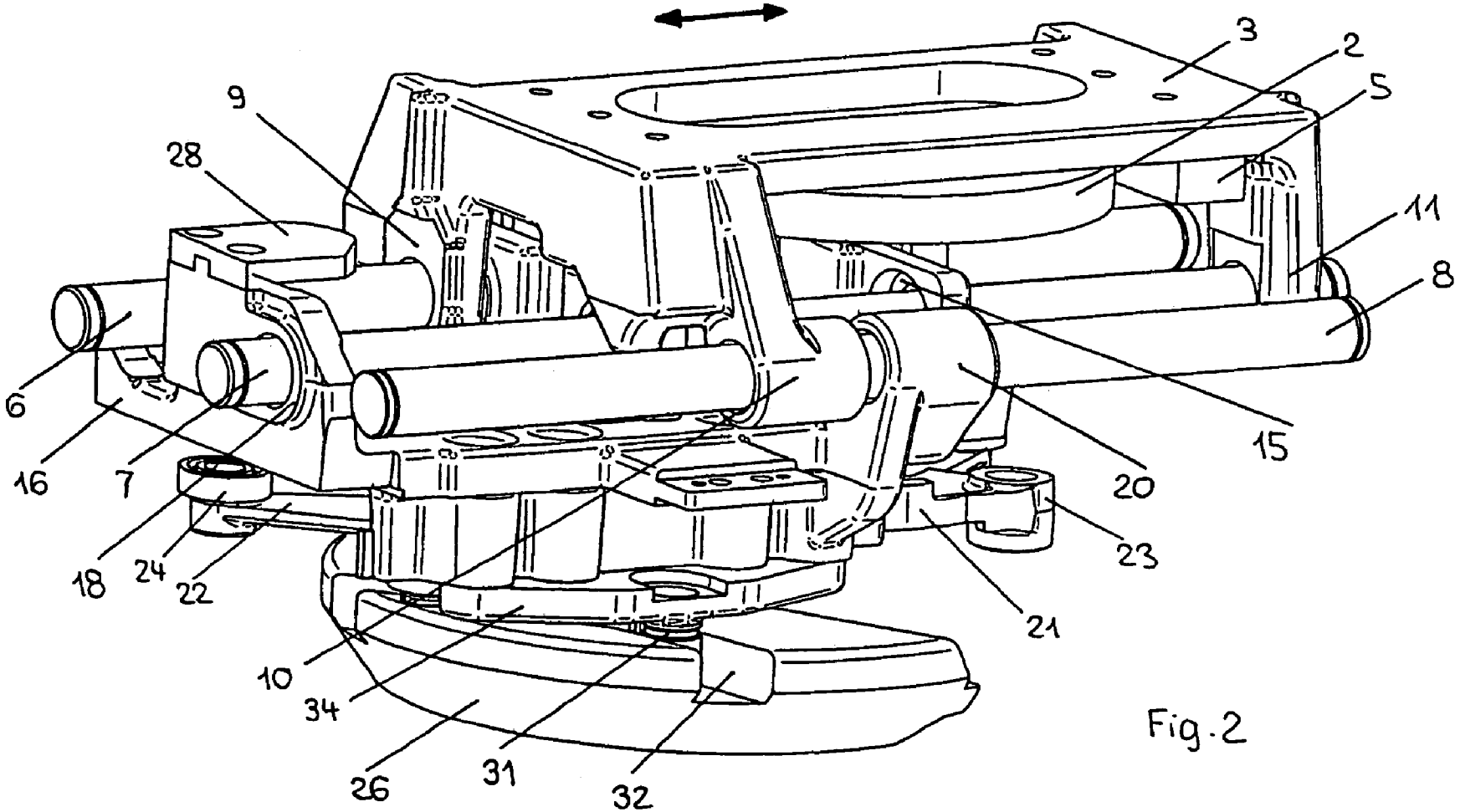
FIG. 2 is a perspective view of this accumulator.
Figure 3:
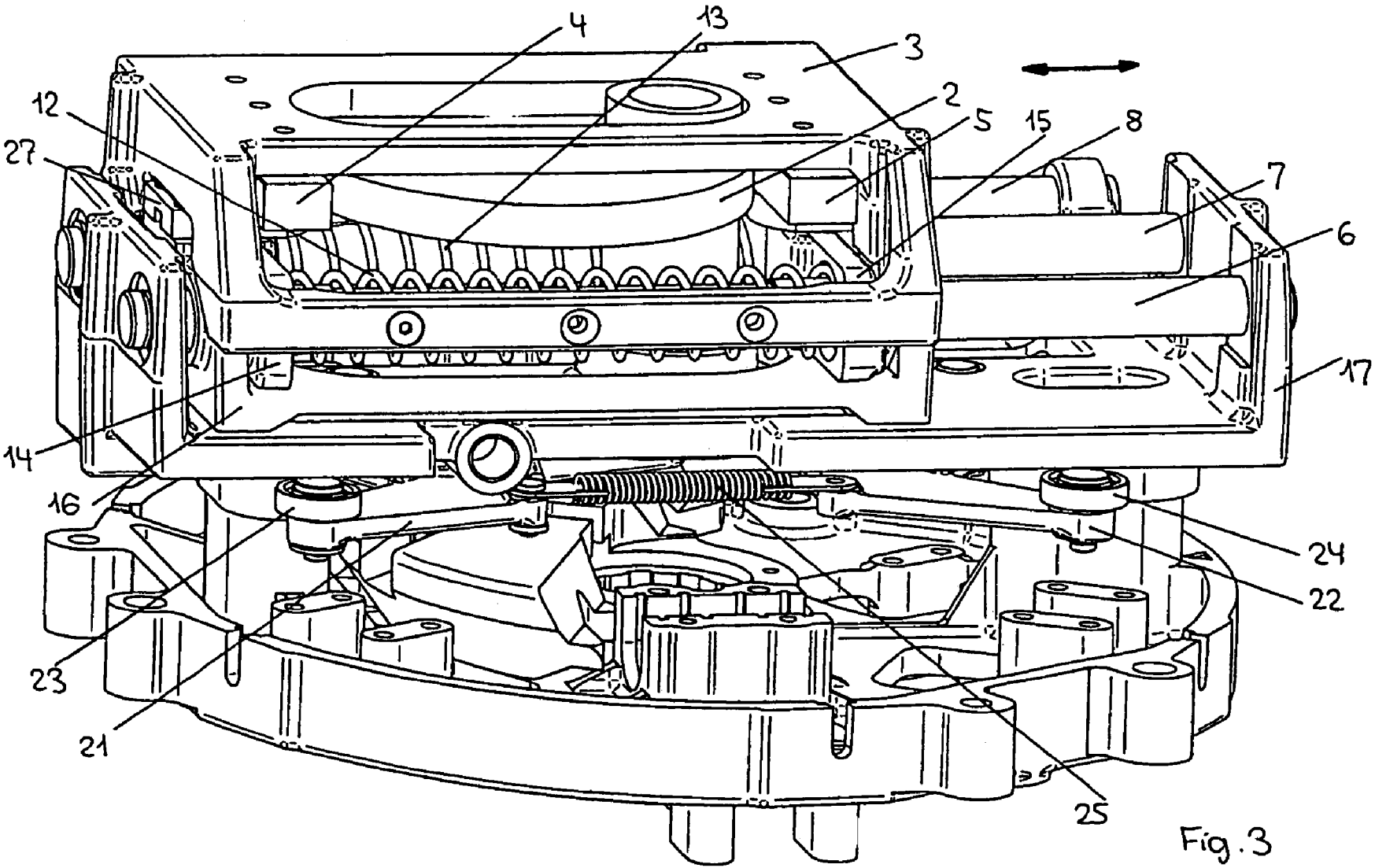
FIG. 3 is a further perspective view of this accumulator from the other side, that is offset by 180° in a horizontal plane.

As known from the state of the art, the here-described force accumulator has an eccentric disk 2 that is connected to an input shaft 1 and that operates a wind-up slide 3 by coacting with driver blocks 4 and 5 provided above and below in the slide 2, spaced apart in its normal travel direction. According to the invention the force accumulator has three parallel guide rods 6, 7, and 8 extending parallel to the travel direction of the slide 3, two of which, in the illustrated embodiment the rods 6 and 7, are surrounded by force-storing springs 12 and 13. The third guide rod 8, also referred to as the support rod, is however not surrounded by a force-storing spring. The slide 3 has on its one end two linear bearings 9 and 10. The bearing 9 surrounds the guide rod 6, and the bearing 10 surrounds the guide rod 8. On its other end the slide 3 has only a single linear bearing 11 that surrounds the guide rod 7. With these three linear bearings in the described arrangement the slide 3 is stable and moves in a defined manner.

As already stated, the force-storing springs 12 and 13 each surround a respective one of the guide rods 6 and 7. Their ends are fixed in and braced against spring seats 14 and 15. The function of the spring seats 14 and 15 is gone into more closely below.

Figure 4:
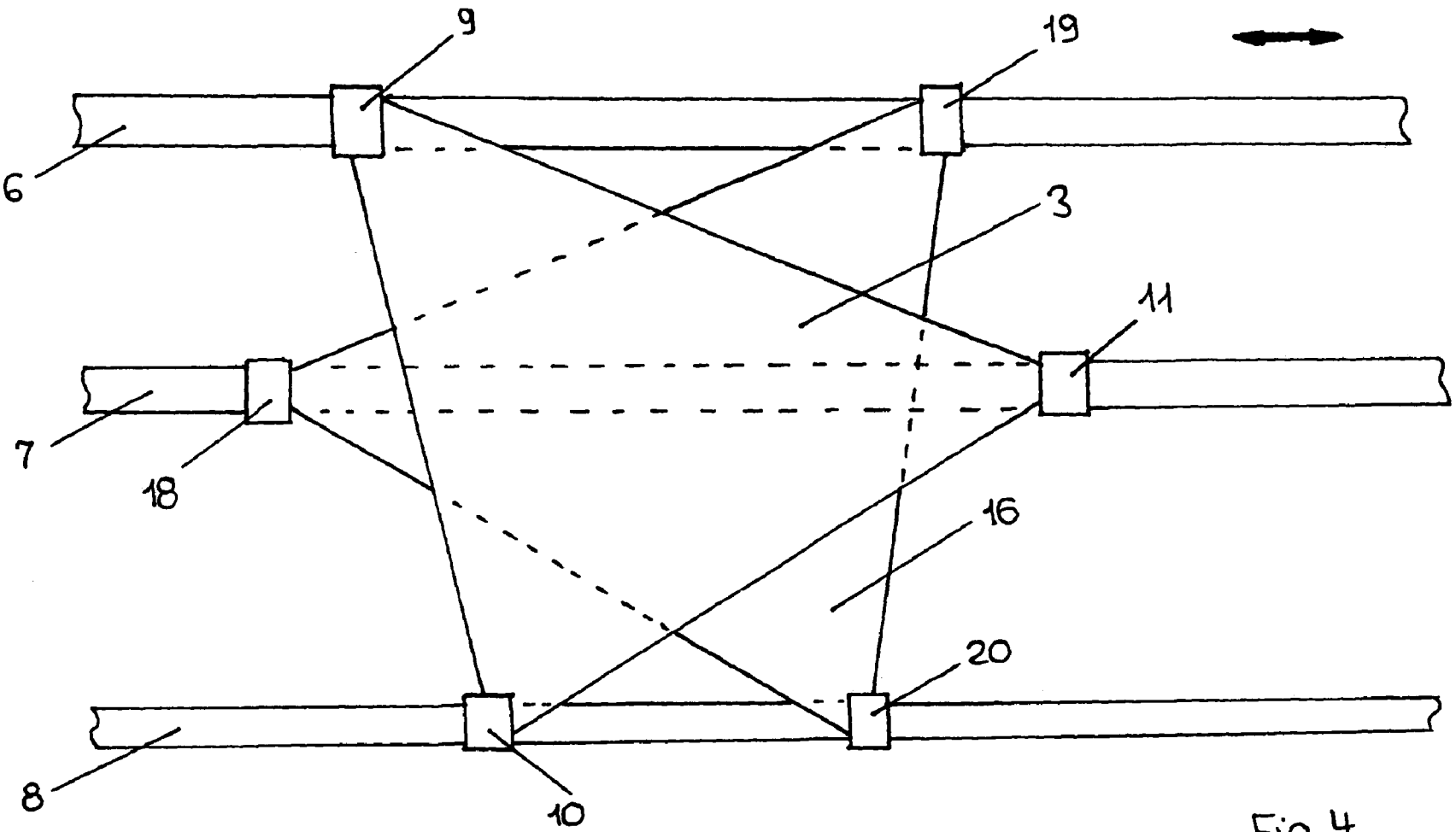
FIG. 4 is a further schematic view showing the principal of three parallel guide rods and the overlap 3-point mounts of the wind-up and jump slides.

A jump slide 16 is movable below the slide 3 in its longitudinal travel direction. This jump slide 16 has at one end, where the slide 3 has two bearing 9 and 10, only a single linear bearing 18 surrounding the guide rod 7. On the other end, where the slide 3 has only a single linear bearing 11, it has on the other hand two separate such linear bearings 19 and 20. The bearing 19 surrounds the guide rod 6 and the bearing 20 the guide rod 8. Thus the jump slide 16 is also stable and moves in a defined manner. FIG. 4 schematically shows these interfitted three-point mounts for the slide 3 and the slide 16. One can see that the individual support points of the two movable parts are practically mirror-images of each other.

The described three guide rods 6, 7, and 8 are each fixed at both ends in a force-accumulator support 17 on which the other mounted parts of the force accumulator according to the invention are mounted.

The movement of one stroke of the force accumulator according to the invention is as follows: The input shaft 1 starts to turn, with it the eccentric disk 2 that slides on the appropriate driver blocks 4 and 5 and thus shifts the wind-up slide 3 longitudinally. Thus the force accumulator springs 12 and 13 are loaded. When the wind-up slide 3 reaches its new end position, these force accumulator springs 12 and 13 are maximally loaded. Up to this time pawls 21 and 22 laterally above and below in the travel direction prevent the jump slide 16 from moving so that it cannot follow movement in the travel direction of the wind-up slide 3. In the new end position of the wind-up slide 3 however, depending on the travel direction, an unillustrated actuator pushes in an upper or lower roller 23 or 24 on the upper or lower pawl 21 and 22. As a result the respective pawl 21 or 22 is pushed against the force of a pawl spring 25 out of its blocking position and the jump slide 16 is released and is fired off by the loaded force-accumulator spring 12 and 13. When it reaches its new end position, the jump slide 16 is blocked by for example the pawls 21 and 22 in the new position. On the next actuation of the force accumulator these described actions are followed, but the wind-up slide 13 and the jump slide 16 move oppositely. The travel directions of the individual parts are shown in the figures by arrows; the force accumulator has a left and right end position between which it shuttles for each changeover.

An appropriate actuator for the rollers 23 and 24 can for example be a vertical actuating plate hanging down laterally from the wind-up slide 3, but it is not shown here for clarity of view because it would have blocked view of other more important parts. Such an actuating plate can be secured at the screw mount 33.

Further the spring seats 14 and 15 were described briefly that are slidable on the guide rods 6 and 7 and that form upper and lower abutments for the force-storing springs. The spring seats 14 and 15 are mounted on the slides 3 and 16 in such a manner that the seats 14 and 15 engage against longitudinal spaced upper and lower abutments and are entrained by these parts during movement either way in the travel direction. This construction is responsible for the already described loading of the force-restoring springs 12 and 13 when the wind-up slide is moved as well as the sudden release and movement of the jump slide 16 both ways in the travel direction.

The springing linear movement of the jump slide 16 is made possible technically for example with a gear connected to a longitudinally extending rack as known from WO 2002/031847 order by a slide block and crank as known from German patent 19 56 369 that converts a rotary movement of an output element 26. In the illustrated embodiment to this end one or two rollers 31 are provided that are mounted on the jump slide and movable along a groove 32 of the output element 26. This output element is connected to an unillustrated output shaft that serves to actuate the load tap changer suddenly, that is trigger the springing changeover between two winding taps while under load. These rollers 31 are mounted via a support 34 on the jump slide 16.

According to another advantageous embodiment of the invention, the force accumulator according to the invention has an additional restoring device. Such an assist unit ensures that even under the hardest operating conditions, for example at very low temperatures and with very viscous oil surrounding the force accumulator, the new end position is surely reached and the force-accumulator is held in this position. It is comprised of upper and lower longitudinally spaced entrainment elements 27 and 28 that interact with a roller pin 29 on the eccentric disk. The roller pin 29 is mounted such that shortly before the end of movement of the jump slide 16 or shortly before it reaches its new end position according to the position of the jump slide it engages either the element 27 or the element 28 and as a result the jump slide 16 is pushed by the still rotating eccentric disk 2 into the new end position, hence it is called the assist unit.

The invention claimed is:

1. A force accumulator for a tap changer wherein:

a longitudinally movable wind-up slide connected with a drive shaft and an also longitudinally movable jump slide connected to an output shaft are provided, the wind-up slide and jump slide are slidable along guide rods extending in their travel direction, between the windup slide and the jump slide there are force-storing springs, the wind-up slide with each changeover of the load tap changer is moved linearly longitudinally in two alternating and opposite directions by the rotating input shaft so that the force-storing springs are loaded, and shortly before reaching a new end position, the wind-up is slide the up-to-then blocked jump slide is released so that it suddenly follows the movement of the wind-up slide, characterized in that, exactly three parallel guide rods are provided, two rods of which are each surrounded by a respective force-storing spring, the windup slide has three linear bearings each surrounding a respective one of the guide rods, and the jump slide has three linear bearings each surrounding a respective one of the guide rods.

2. The force accumulator according to claim 1, characterized in that the forcestoring springs have ends mounted in seats that are all freely independently movable on the guide rods, and that the spring seats are carried at one end on the wind-up slide and at the other end on the jump slide such that the spring seats engage abutments of the wind-up slide and of the jump slide and are shifted by these parts in the two travel directions.

3. The force accumulator according to claim 1, characterized in that the force-storing springs have ends mounted in seats that are all freely independently movable on the guide rods, and that the spring seats are carried at one end on the wind-up slide and at the other end on the jump slide such that the spring seats engage abutments of the wind-up slide and of the jump slide and are shifted by these parts in both travel directions.

4. The force accumulator according to claim 1, characterized in that the jump slide has entrainment elements that coact with a roller pin on the eccentric disk, and the roller pin is positioned such that shortly before reaching an end position the jump slide engages one of the elements such that still rotating eccentric disk pushes the jump slide into the new end position.

* * * * *